US005722823A

United States Patent [19]

Hodgkiss

[11] Patent Number: 5,722,823

[45] Date of Patent: Mar. 3, 1998

[54] GAS IGNITION DEVICES

[76] Inventor: Neil John Hodgkiss, Waterloo, Cheltenham Road, Bredon, Tewkesbury, GL20 7NA, England

[21] Appl. No.: 552,313

[22] Filed: Nov. 8, 1995

[30] Foreign Application Priority Data

Nov. 18, 1994 [GB] United Kingdom ..... 9423271

[51] Int. Cl.[6] ..... F23Q 9/08

[52] U.S. Cl. ..... 431/43; 431/73; 431/80; 126/42; 126/39 BA

[58] Field of Search ..... 431/81, 69, 73, 431/80, 43; 126/42, 39 BA, 39 E

[56] References Cited

U.S. PATENT DOCUMENTS 5,450,841 9/1995 Whitaker et al. ..... 126/512

FOREIGN PATENT DOCUMENTS 2 267 335 12/1993 United Kingdom .
2 282 660 4/1995 United Kingdom .

*Primary Examiner*—Larry Jones
*Attorney, Agent, or Firm*—Young & Thompson

[57] ABSTRACT

In a gas appliance, such as a domestic gas fire or heater, there is provided a gas ignition device comprising a solenoid actuator which is electrically operable to cause a gas valve to initiate a gas flow, an igniter which is electrically operable to ignite the gas flow, and a remote control unit connected to the gas actuator and the igniter by a low voltage line. The control unit incorporates a power supply for providing a low voltage output and a timer circuit for applying the low voltage output to the line by actuation of a relay to cause gas ignition in response to manual actuation of a switch. Such a gas ignition device is advantageous because the remote control unit can be mounted at some distance from the appliance so that none of the circuit components of the remote control unit is subjected to high temperature in use, and there is no requirement for a high voltage supply to the appliance itself and only low voltages are supplied to the inside of the appliance.

9 Claims, 2 Drawing Sheets

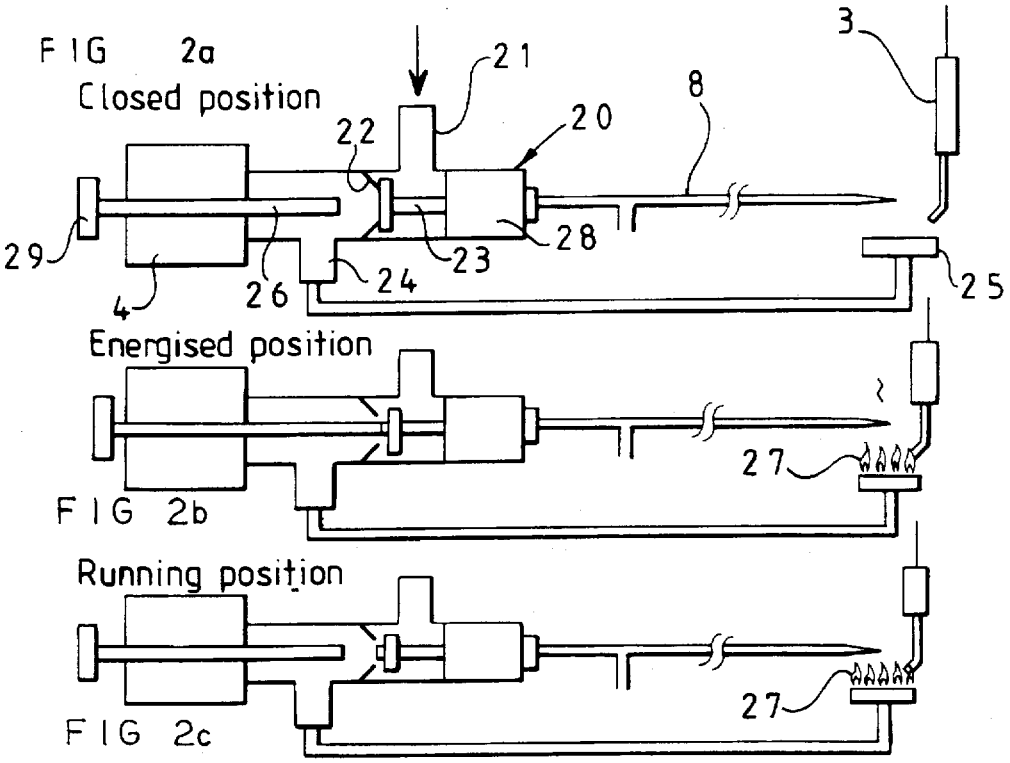
FIG 2a
Closed position
21
20
22
8
3
29
4
26
24
23
28
25
Energised position
27
FIG 2b
Running position
27
FIG 2c
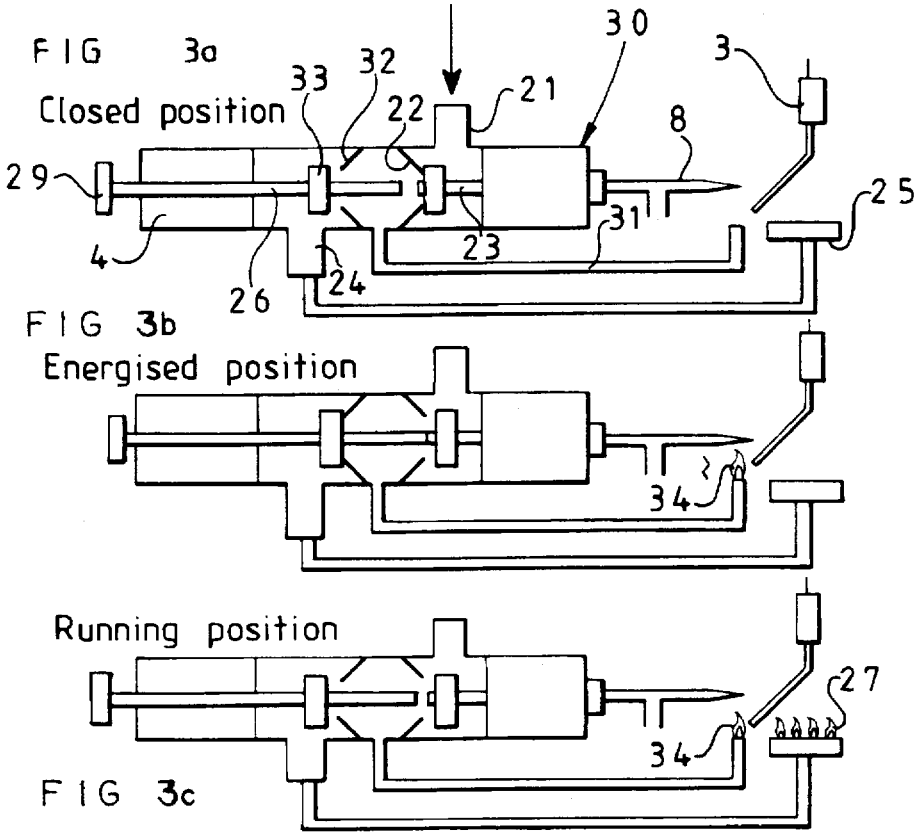
FIG 3a
Closed position
30
33
32
22
21
3
8
29
4
26
24
23
31
25
FIG 3b
Energised position
34
Running position
27
34
FIG 3c

GAS IGNITION DEVICES

This invention relates to gas ignition devices.

BACKGROUND OF THE INVENTION

It is well known for a gas appliance, such as a domestic gas fire or heater, to incorporate an electronic ignition device for automatically igniting the gas flow. The gas flow may be controlled by a solenoid valve so that either a pilot flow of gas or the main flow of gas is initiated automatically at the same time as an igniter is operated to light the gas by means of a spark. Once ignition has taken place satisfactorily, the appliance may run normally, a thermocouple controlled interrupter being provided to cut off the supply of gas in the event that the flame is extinguished.

Generally the appliance incorporates power supply and timer circuitry for operating the solenoid valve and the igniter, and a mains supply lead is connected to the appliance to supply a mains voltage to the circuitry. However such an arrangement requires the electronic circuit components mounted on the appliance and the mains supply lead to be capable of withstanding the heat of the appliance, and in addition requires that special measures be taken to ensure that the risk of the user or installer being electrocuted is minimised.

It is an object of the invention to provide an improved gas ignition device which overcomes these difficulties.

SUMMARY OF THE INVENTION

According to the present invention there is provided a gas ignition device comprising a gas actuator which is electrically operable to cause a gas valve to initiate a gas flow, an igniter which is electrically operable to ignite the gas flow, and a remote control unit connected to the gas actuator and the igniter by low voltage line means and incorporating a power supply for providing a low voltage output and a timer circuit for applying the low voltage output to the line means to cause gas ignition in response to an appropriate actuating signal.

Such a gas ignition device is advantageous because the remote control unit can be mounted at some distance from the appliance so that none of the circuit components of the remote control unit is subjected to high temperatures in use. Thus these components need not be specially adapted to withstand high temperatures, and accordingly the control unit can be produced at lesser cost than if it were necessary for the components to withstand such temperatures. In addition, since there is no requirement for a high voltage supply to the appliance itself, the appliance is effectively isolated from the mains supply, and only low voltages are supplied to the inside of the appliance. This substantially removes the danger to the installer of the appliance who will generally be a plumber rather than an electrician and may therefore not be competent to handle hazardous voltages.

The igniter may be a piezoelectric igniter or any other form of igniter or re-igniter providing either continuous sparking or sparking which stops when ignition takes place.

In a preferred embodiment of the invention the remote control unit is adapted to be connected to the mains supply by an isolating transformer.

Conveniently the remote control unit is integrally formed with a plug for fitting to a mains supply socket, the plug and the control unit being mounted within a common casing. However it is also possible for the control unit to be provided with a mains lead having a plug at one end, and to be mounted at a distance from the mains socket, for example on a wall surface.

Preferably the device incorporates a manual actuating switch which, when actuated by the user, supplies an actuating signal to cause the low voltage output to be applied to the line means to cause gas ignition. The manual actuating switch may be adapted to be mounted at a distance from the control unit, for example on a wall surface.

Preferably a holding circuit is provided for holding the gas valve in the open position so as to provide for gas flow during running of the appliance after initiation of gas flow by the gas actuator during gas ignition.

Furthermore the holding circuit may include a thermocouple connector, for connection to a thermocouple in the vicinity of the flame produced by the gas ignition, for stopping the gas flow in response to extinguishing of the flame as detected by the thermocouple. The holding circuit may include an interrupter for stopping the gas flow in the event of power failure.

In one embodiment a latching circuit is provided which, on actuation of the switch, is placed in a latched state to enable holding of the gas valve in the open position by the holding circuit, and which, on subsequent power failure, is placed in an unlatched state to inhibit holding of the gas valve in the open position by the holding circuit, whereby gas flow is prevented until ignition is again effected by manual operation of the switch.

Advantageously switching means is provided under control of the timer circuit to effect low voltage power supply to the gas actuator and the igniter for a predetermined period of time during gas ignition.

The power supply of the control unit preferably comprises a mains transformer, and a bridge rectifier and a smoothing capacitor for rectifying and smoothing the output of the transformer.

BRIEF DESCRIPTION OF THE DRAWINGS

In order that the invention may be more fully understood, reference will now be made, by way of example, to the accompanying drawings, in which:

FIGS. 2(*a*)–(*c*) and 3(*a*)–(*c*) are explanatory diagrams showing, in three successive operating states, two possible forms of gas valve for use with the gas ignition device of FIG. 1.

DETAILED DESCRIPTION OF THE DRAWINGS

Figure 1:
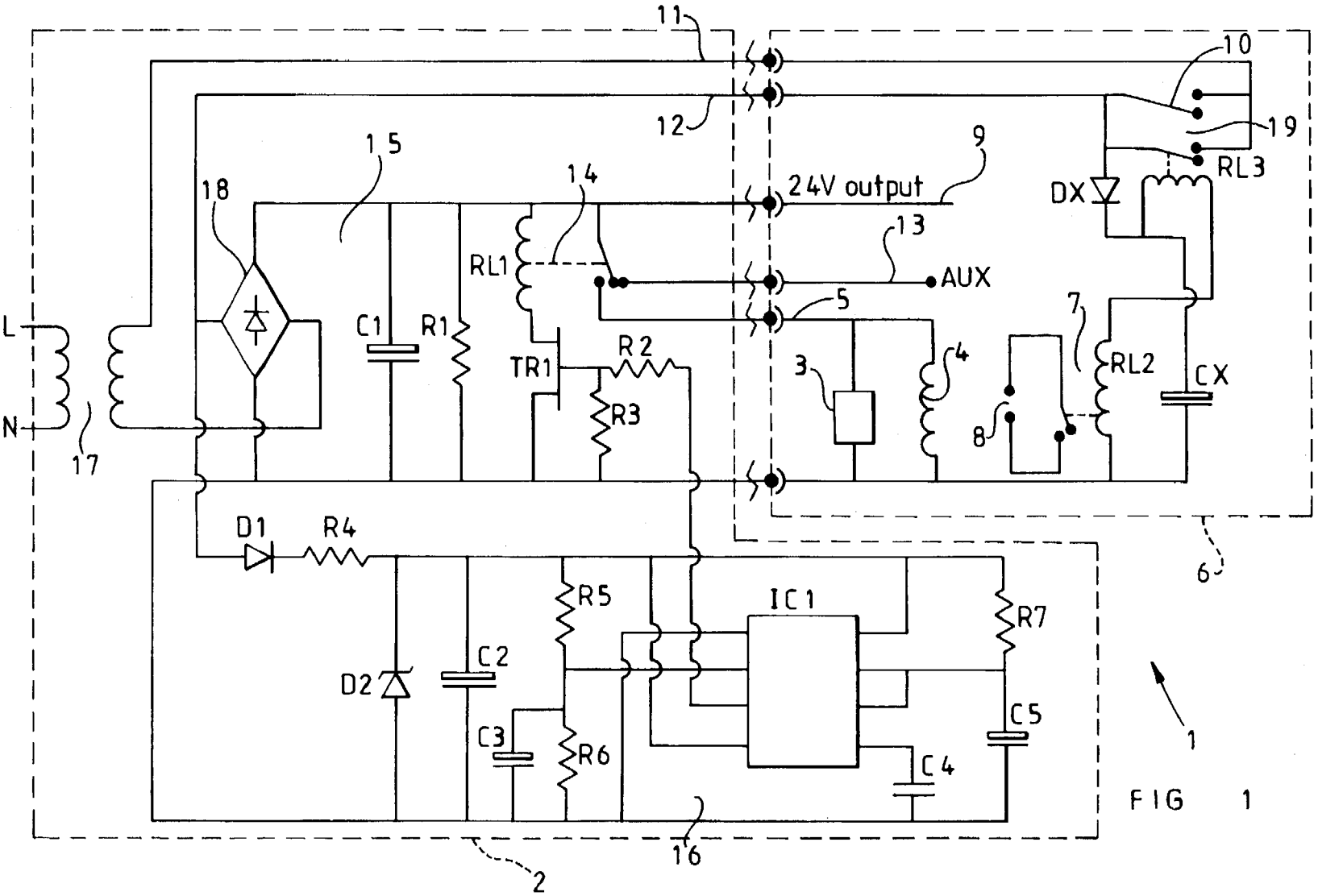
FIG. 1 is a circuit diagram of a gas ignition device in accordance with the invention.

Referring to FIG. 1 the illustrated gas ignition device 1 comprises a remote control unit 2 which is integrally formed with an adaptor plug for fitting into a mains socket, and a module 6 fitted to the gas appliance connected to the remote control unit by a low voltage lead. The module 6 includes an igniter 3 and a solenoid coil 4 of a gas valve connected to the control unit 2 by a low voltage line 5 of the lead. In addition a relay interrupter 7 of a thermocouple circuit 8 is connected to the control unit 2 by way of a push button switch 10 and low voltage lines 11 and 12 of the lead. An auxiliary supply line 13 is provided in the lead for supply of low voltage to an auxiliary device. Furthermore a constant 24V DC output supply line 9 is provided for supplying a 24V output to a further device, such as a carbon monoxide sensor or remote switch.

The control unit 2 comprises, within a plastics casing which also incorporates the plug, a power supply 15 and a timer circuit 16 for effecting timed supply of the output of the power supply 15 to the igniter 3 and solenoid coil 4 during an ignition operation. The power supply 15 comprises an isolating mains transformer 17 having its input connected to mains (250V or 110V AC), a bridge rectifier 18 for rectifying the output of the transformer 17, a smoothing capacitor C1 and resistor R1. The timer circuit 16 comprises a timing integrated circuit IC1 and associated timing resistors R5, R6 and R7 and capacitors C3, C4 and C5. Furthermore the supply from the power supply 15 to the timer circuit 16 is rectified and smoothed by the rectifier D1 and associated resistor R4 and capacitor C2, and additionally voltage stabilization is provided by the zener diode D2.

The power supply 15 is connected to the voltage line 5 supplying the igniter coil 3 and the solenoid coil 4 by way of a timer relay 14 having a coil RL1 connected in series with a field effect transistor TR1 having a gate biased by a resistor R3 and connected to the integrated circuit IC1 by a resistor R2. Furthermore the power supply 15 is connected to the relay interrupter 7 by way of the switch 10, a rectifier DX, a latching relay 19 and a smoothing capacitor CX. The coils RL2 and RL3 of the interrupter 7 and the latching relay 19 are connected in series.

In operation of the gas ignition device 1 to effect automatic ignition of a gas appliance, the push-button switch 10 is manually pressed by the user in order to cause latching of the relay 19 so that power is supplied by the power supply 15 to the timer circuit 16. In response to such supply of power the timer circuit 16 supplies a timing pulse to the gate of the transistor TR1 so as to energise the coil RL1 of the relay 14 and to thereby close the contacts of the relay 14 (which are normally open in order to supply 24V to the auxiliary supply line 13). This results in the supply of power from the power supply 15 to the igniter 3 and the solenoid coil 4 of the gas valve. The effect of this load on the power supply output is to reduce the voltage to each of the components to 12V, this voltage being maintained for a predetermined period of time (typically fifteen seconds) determined by the timer circuit 16.

However, as will be appreciated from the description below with reference to FIGS. 2(*a*)–(*c*) and 3(*a*)–(*c*), the solenoid coil 4 will only open the gas valve to permit ignition of the gas appliance provided that the thermocouple circuit 8 is energised by closing of the contacts of the interrupter 7. As long as power is supplied to the device, the contacts of the relay 19 will remain closed and power will be supplied to the coil RL2 of the interrupter 7 by way of the coil RL3 of the relay 19. However, in the event of a power failure, the contacts of the relay 19 will open and this will result in opening of the contacts of the interrupter 7 in order to de-energise the thermocouple circuit 8 so that the supply of gas to the appliance is cut off. Thus, following a power failure, the appliance cannot be re-ignited on resumption of power except by deliberate action being taken to actuate the switch 10.

Provided that the thermocouple circuit 8 is energised during the ignition cycle, energisation of the igniter 3 and solenoid coil 4 during the timed period will result in ignition of the burner of the appliance, as described in more detail below with reference to FIGS. 2(*a*)–(*c*) and 3(*a*)–(*c*). At the end of the timed period the transistor TR1 is turned off by the timer circuit 16 and the contacts of the relay 14 change over to the normally closed position and as a result power is removed from the igniter 3 and the solenoid coil 4. This causes the voltage output of the power supply 15 to increase to 20–24V DC. When the timer contacts of the relay 14 are in the normally closed position, an auxiliary control device, such as a solenoid operated gas control valve operated by way of a switch or an infra-red or ultrasonic control device, may be supplied with power by the power supply 15 by way of the auxiliary supply line 13.

After ignition has been effected by energisation of the igniter 3 and solenoid coil 4 of the gas valve, the power is removed both from the igniter 3 and the solenoid coil 4 and the appliance runs normally. To turn off the appliance either the switch 10 or a switch on the mains socket is switched off in order to de-energise the interrupter 7 which will in turn open circuit the thermocouple circuit 8 and close off the gas valve. If required a carbon monoxide sensing device may be incorporated in the supply line 11 to the switch 10 so that ignition is prevented or the appliance is turned off in the event that a carbon monoxide concentration threshold is exceeded.

The gas valve may be a FFD (flame failure device) valve of the direct burner type as shown diagrammatically in three successive operating states in FIGS. 2(*a*)–(*c*). In this case the valve 20 has a gas inlet 21, a valve seat 22, a valve member 23 normally closing off the valve seat 22, a gas outlet 24 connected to the gas burner 25 of the appliance, and an actuating member 26 which may be caused on energisation of the solenoid coil 4 to displace the valve member 23 from the valve seat 22 to permit supply of gas by way of the outlet 24 to the burner 25, where it is ignited by the igniter 3 to form a flame 27. The thermocouple circuit 8 is connected to a magnet unit 28 and extends in the vicinity of the flame 27 so that, when the thermocouple circuit 8 is energised and the flame 27 is lit, the magnet unit 28 holds the valve member 23 in the open position after the actuator 26 has been retracted following de-energisation of the solenoid coil 4. In the event that the thermocouple circuit 8 senses flame cutout or is open circuited by de-energisation of the interrupter 7 during running, the valve member 23 is released by the magnet unit 28 and engages the valve seat 22 in order to cut off the supply of gas to the burner 25. A manually operable override 29 can also be provided for displacing the actuator 26 to control the position of the valve member 23 in the event of a power failure. A battery (which may be rechargeable) may be provided for maintaining the supply of power to the interrupter 7 in the event of a power failure, although in this mode the control of the appliance will be limited.

Alternatively the FFD valve can be an ignition burner device 30 as shown in FIGS. 3(*a*)–(*c*) having an ignition bypass duct 31. In this case the valve has a secondary valve seat 32 and a secondary valve member 33 mounted on the actuating member 26 so that, when the actuating member 26 is actuated by energisation of the solenoid coil 4, the valve member 23 is displaced from the valve seat 22 to permit gas to be supplied from the gas inlet 21 to the bypass duct 31, and at the same time the secondary valve member 33 is seated on the valve seat 32. The resulting supply of gas to the bypass duct 31 is ignited by the igniter 3 to produce an ignition flame 34. Subsequent de-energisation of the solenoid coil 4 returns the actuating member 26 to its initial position in which the valve member 33 is retracted from the valve seat 32 and gas supply is thereby permitted by way of the outlet 24 to the burner 25 which is therefore lit from the ignition flame 34 to produce the main flame 27. Supply of gas to both the burner 25 and the bypass duct 31 is stopped by movement of the valve member 23 to engage the valve seat 22 in the event that the thermocouple circuit 8 senses flame cutout or is open circuited by de-energisation of the interrupter 7.

Instead of the switch 10 forming an integral part of the module 6, it may be a remote wall switch. Furthermore the switch 10 may be replaced by an infra-red receiver to enable actuation by an infra-red remove control unit. Additional controls may be fitted for control of the gas flow, such as a solenoid operated gas control valve or gas tap.

The gas ignition device described with reference to FIG. 1 is advantageous since it isolates the appliance from the mains supply by means of the transformer, and ensures that the control components are remote from the ignition zone. Since only low voltages are supplied to the appliance, standard (five way) telephone cables can be utilised for connection of the control unit to the appliance, and there is no danger that the user or installer of the appliance will be electrocuted. The transformer characteristics are such that the control unit can be provided with an integral plug so that it can be directly mounted on a standard mains socket, and in addition the transformer can incorporate overload protection to protect the control unit in the event of a continuous overload. Since the igniter and the solenoid coil are de-energised during normal running of the appliance, higher ambient temperature tolerance is provided.

I claim:

1. A gas ignition device comprising:

a low voltage operating module adapted to be fitted to a gas appliance, said module comprising a gas actuator which is electrically operable to cause a gas valve to initiate a gas flow, and an igniter which is electrically operable to ignite the gas flow; and a remote control unit that is spaced from said module and is connected to the gas actuator and the igniter by low voltage line means, said remote control unit comprising a power supply having an isolating transformer that is adapted to be connected to a high voltage mains supply for providing a low voltage output, and a timer circuit for applying the low voltage output to the low voltage line means to cause gas ignition in response to an appropriate actuating signal from said module.

2. A device according to claim 1, wherein the remote control unit is integrally formed with a plug for fitting to a mains supply socket, the plug and the control unit being mounted within a common casing.

3. A device according to claim 1, wherein said module further comprises a manual actuating switch which, when actuated by the user, supplies the actuating signal to cause the low voltage output to be applied to the line means to cause gas ignition.

4. A device according to claim 1, wherein said module further comprises a holding circuit for holding the gas valve in the open position so as to provide for gas flow during running of the appliance after initiation of gas flow by the gas actuator during gas ignition.

5. A device according to claim 4, wherein the holding circuit includes a thermocouple connector, for connection to a thermocouple in the vicinity of the flame produced by the gas ignition, for stopping the gas flow in response to extinguishing of the flame as detected by the thermocouple.

6. A device according to claim 4, wherein the holding circuit includes an interrupter for stopping the gas flow in the event of power failure.

7. A device according to claim 4, wherein said module further comprises a latching circuit which, on receipt of the actuating signal, is placed in a latched state to enable holding of the gas valve in the open position by the holding circuit, and which, on subsequent power failure, is placed in an unlatched state to inhibit holding of the gas valve in the open position by the holding circuit, whereby gas flow is prevented until ignition is again effected by receipt of the actuating signal.

8. A device according to claim 1, wherein said remote control unit further comprises switching means under control of the timer circuit to effect low voltage power supply to the gas actuator and the igniter for a predetermined period of time during gas ignition.

9. A device according to claim 1, wherein the power supply of the remote control unit further comprises a bridge rectifier and a smoothing capacitor for rectifying and smoothing the output of the isolating transformer.

* * * * *